US005444363A

United States Patent [19]

Cabler

[11] Patent Number: 5,444,363

[45] Date of Patent: Aug. 22, 1995

[54] LOW NOISE APPARATUS FOR RECEIVING AN INPUT CURRENT AND PRODUCING AN OUTPUT CURRENT WHICH MIRRORS THE INPUT CURRENT

[75] Inventor: Carlin D. Cabler, Austin, Tex.

[73] Assignee: Advanced Micro Devices Inc., Sunnyvale, Calif.

[21] Appl. No.: 168,628

[22] Filed: Dec. 16, 1993

[51] Int. Cl.[6] ..... G05F 3/16

[52] U.S. Cl. ..... 323/315

[58] Field of Search ..... 323/312, 315, 316, 317; 307/296.1, 296.6; 330/288

[56] References Cited

U.S. PATENT DOCUMENTS

| | | | |
|---|---|---|---|
| 4,829,266 | 5/1989 | Pernici et al. | 330/253 |
| 4,897,596 | 1/1990 | Hughes et al. | 323/315 |
| 4,939,516 | 7/1990 | Early | 341/143 |
| 5,039,989 | 8/1991 | Welland et al. | 341/143 |
| 5,113,129 | 5/1992 | Hughes et al. | 323/316 |
| 5,126,685 | 6/1992 | Platt et al. | 330/85 |
| 5,243,235 | 9/1993 | Wakayama et al. | 307/353 |

*Primary Examiner*—Steven L. Stephan
*Assistant Examiner*—Matthew V. Nguyen
*Attorney, Agent, or Firm*—Fulbright & Jaworski

[57] ABSTRACT

A low noise apparatus for receiving an input current and producing an output current which mirrors the input current significantly increases accuracy and signal-to-noise ratio by greatly reducing the effects resulting from threshold voltage mismatches and $1/f$ noise. The apparatus comprises two cascode current mirrors. Further, the apparatus comprises a switching network which, in turn, comprises a plurality of switches formed within either a first or second electrical path. A first clock controls the switches formed within the first electrical path, while a second clock controls the switches formed within the second electrical path. When the first clock is in its first state and the second clock is in its second state, the switches formed within the first electrical path close to form the first cascode current mirror. However, the switches formed within the second electrical path remain open. Conversely, when the first clock is in its second state and the second clock is in its first state, the switches formed within the second electrical path close to form the second cascode current mirror. However, the switches formed within the first electrical path remain open. Consequently, the apparatus modulates a significant percentage of the threshold voltage mismatch up to the operating frequency of the two clocks. As a result, the first order error term resulting from the threshold voltage mismatch is eliminated and $1/f$ noise is reduced.

8 Claims, 9 Drawing Sheets

LOW NOISE APPARATUS FOR RECEIVING AN INPUT CURRENT AND PRODUCING AN OUTPUT CURRENT WHICH MIRRORS THE INPUT CURRENT

BACKGROUND OF THE INVENTION

1. Field of the Invention

The present invention relates to current mirrors and, more particularly, but not by way of limitation, to a low noise apparatus for producing an output current which mirrors the input current.

2. Description of the Related Art

Audio chips presently enable personal computers, compact disk players, and other portable audio devices to execute high quality, low power audio applications. Audio chips usually comprise digital circuitry which occupies approximately 75–80% of the audio chip's silicon space and analog circuitry which occupies the remaining 20–25%. Typically, the analog circuitry comprises an analog-to-digital converter, a digital-to-analog converter, and some output amplifiers. The analog circuitry converts an analog audio input signal into a digital format suitable for processing by the digital circuitry. Also, the analog circuitry converts the digital signals back into an analog format suitable to drive a load, such as a speaker. The digital circuitry occupies the majority of the silicon area and typically performs digital signal processing, such as filtering, noise shaping, and synthesizing on the converted analog signals. The primary function of these audio chips is to implement an entire audio system on one piece of silicon.

The above-described analog circuitry typically comprises current mirrors. These current mirrors serve several important functions, such as providing reference currents and reference voltages to other components in the analog circuitry. Therefore, these current mirrors must have very good matching characteristics and low noise (i.e., must have a large signal to noise ratio) to improve, illustratively, the output swing of the output amplifiers and the overall reliability and accuracy of the analog circuitry.

FIG. 1 illustrates current mirror 100, which is a conventional cascode current mirror comprising N-channel transistors 110, 120, 130, and 140. Transistors 110, 120, 130, and 140 are enhancement-type, metal-oxide silicon field effect transistors (i.e., MOSFETs). For the output current (i.e., $I_{OUT}$) Of current mirror 100 to exactly match (i.e., mirror) the input current (i.e., $I_{IN}$), transistors 110 and 130 must have identical threshold voltage drops (i.e., $V_T$) and gate-to-source voltage drops (i.e., $V_{GS}$). Similarly, transistors 120 and 140 must have identical threshold voltage drops (i.e., $V_T$) and gate-to-source voltage drops (i.e., $V_{GS}$). These requirements for current mirror 100 will become evident from the equations defining $I_{OUT}$ and $I_{IN}$ (described herein).

Transistors 120 and 140 have identical $V_{GS}$ because their sources are connected to a reference voltage (e.g., ground) and their gates are connected to each other. Similarly, transistors 110 and 130 have nearly identical $V_{GS}$ because their gates are connected to each other and they have identical drain currents.

Moreover, to have identical $V_{GS}$ and $V_T$ drops, transistors 110 and 130 must be equal in size (i.e., width and length) and transistors 120 and 140 must be equal in size. Therefore, transistors 110 and 130 and transistors 120 and 140 are fabricated to be as close in size as possible. Unfortunately, however, two exactly sized transistors cannot be fabricated due to inherent errors associated with currently available fabrication techniques. Consequently, the $V_T$ of transistors 120 and 140 and transistors 110 and 130 are not identical. A first-order model of this threshold voltage mismatch (i.e., $\Delta V_T$) between transistors 120 and 140 is illustrated in FIG. 2.

Referring to FIG. 2, the input current $I_{IN}$ of current mirror 100 can be approximated by the following equation:

$$I_{IN}=(k')(w/l)(V_{GS}-V_T)^2 \quad (1)$$

where k' is a process parameter, w/l is the size (i.e., width and length) of transistor 120, $V_T$ is the threshold voltage of transistor 120, and $V_{GS}$ is the gate-to-source voltage of transistor 120.

The voltage at the gates of transistors 120 and 140 (i.e., $V_A$) can be approximated by the following equation:

$$V_A=\Delta V_T+V_{GS} \quad (2)$$

Therefore, substituting equation (2) into equation (1) and solving for $V_A$:

$$I_{IN}=(k')(w/l)[V_A-\Delta V_T-V_T]^2$$

$$V_A=\Delta V_T+V_T+[I_{IN}/(k'(w/l))]^{1/2} \quad (3)$$

Similarly, $I_{OUT}$ may be approximated by the following equation:

$$I_{OUT}=(K')(w/l)(V_{GS}-V_T)^2 \quad (4)$$

where k' is the process parameter, w/l is the size (i.e., width and length) of transistor 140, $V_T$ is the threshold voltage of transistor 140, and $V_{GS}$ is the gate-to-source voltage of transistor 140. Substituting equation (2) into equation (4) and solving:

$$I_{OUT}=(k')(w/l)[V_A-V_T]^2 \quad (5)$$

Substituting equation (3) into equation (5) and solving:

$$I_{OUT} = (k')(w/l)[(I_{IN}/(k'(w/l))^{\frac{1}{2}} + \Delta V_T + V_T - V_T]^2 \quad (6)$$
$$I_{OUT} = (k')(w/l)[(I_{IN}/(k'(w/l))^{\frac{1}{2}} + \Delta V_T]^2$$
$$I_{OUT} = (k')(w/l)[I_{IN}/(k'(w/l)) + 2\Delta V_T(I_{IN}/(k'(w/l))^{\frac{1}{2}} + (\Delta V_T)^2]$$
$$I_{OUT} = I_{IN} + 2(k')(w/l)(\Delta V_T)[I_{IN}/(k'(w/l))]^{\frac{1}{2}} + k'(w/l)(\Delta V_T)^2$$

Accordingly, the first order and second order terms $2(k')(w/l)(\Delta V_T)[I_{IN}/(k'(w/l))]^{1/2}$ and $k'(w/l)(\Delta V_T)^2$ (see equation 6) are error terms resulting from the threshold voltage mismatch $\Delta V_T$.

Illustratively, if $I_{IN}=50\ \mu A$, $k'=43\times10^{-6}\ A/V^2$, $w/l=100/10$, and $\Delta V_T=10$ mV, then:

$$I_{OUT}=50\times10^{-6}+2.61\times10^{-6}+0.034\times10^{-6}$$

$$I_{OUT}=52.644\ \mu A$$

Thus, for an input current of 50 μA, the output current of current mirror 100 is 52.644 μA. This disparity in input and output currents produces an error rate of 5.3% The majority of this error is attributable to the first order error term in equation 6. Therefore, if a new and improved current mirroring apparatus could be designed which would significantly reduce the mismatch/noise and, thus, the error rate resulting from the threshold voltage mismatch $\Delta V_T$, the overall reliability and accuracy of the analog circuitry would be greatly increased.

SUMMARY

The first and second embodiments of the present invention comprise a new and improved low noise current mirroring apparatus having an input for receiving an input current and an output for producing an output current which mirrors the input current. This apparatus significantly increases the signal-to-noise ratio by greatly reducing low frequency noise (i.e., $1/f$) and mismatch resulting from threshold voltage mismatches. In a first embodiment, the apparatus comprises four transistors, each having a control terminal and a first and second terminal, and a switching network comprising a plurality of switches formed within either a first or second electrical path. In a second embodiment, this apparatus comprises: 1) four transistors, each having a control terminal and a first and second terminal; 2) two bias transistors which bias the gates of the first and second transistors; and 3) a switching network comprising a plurality of switches formed within either a first or second electrical path.

In the first embodiment, a first clock controls the switches formed within the first electrical path, while a second clock controls the switches formed within the second electrical path. When the first clock is in its first state and the second clock is in its second state, the switches formed within the first electrical path close to connect the second terminal of the first and second transistors to the second terminal of the third and fourth transistors, respectively. Further, the second terminal of the third transistor connects to the control terminals of the third and fourth transistors. However, the switches formed within the second electrical path remain open.

Conversely, when the first clock is in its second state and the second clock is in its first state, the switches formed within the second electrical path close to connect the second terminal of the first and second transistors to the second terminal of the fourth and third transistors, respectively. Further, the second terminal of the fourth transistor connects to the control terminals of the third and fourth transistors. However, the switches formed within the first electrical path remain open.

In the second embodiment, a first clock controls the switches formed within the first electrical path, while a second clock controls the switches formed within the second electrical path. When the first clock is in its first state and the second clock is in its second state, the switches formed within the first electrical path close to connect the first terminal of the first transistor to both the input and the control terminals of the third and fourth transistors. Further, the first terminal of the second transistor connects to the output. However, the switches formed within the second electrical path remain open.

Conversely, when the first clock is in its second state and the second clock is in its first state, the switches formed within the second electrical path close to connect the first terminal of the first transistor to the output. Further, the first terminal of the second transistor connects to both the input and the control terminals of the third and fourth transistors. However, the switches formed within the first electrical path remain open.

Consequently, both embodiments of the apparatus modulate a significant percentage of the threshold voltage mismatch up to the operating frequency of the two clocks. As a result, the first order error term resulting from the threshold voltage mismatch $\Delta V_T$ is eliminated.

It is therefore an object of the present invention to provide a current mirroring apparatus having a large signal-to-noise ratio.

It is another object of the present invention to provide a current mirroring apparatus which is capable of eliminating the first order error term resulting from a threshold voltage mismatch.

It is a further object of the present invention to provide a current mirroring apparatus which switches the connections of a plurality of transistors using a switching network.

It is still another object of the present invention to provide a current mirroring apparatus which mitigates the adverse effects of threshold voltage mismatches.

These and other objects, features, and advantages of the present invention will become evident to those skilled in the art in light of the following drawings and detailed description of the preferred embodiment.

DETAILED DESCRIPTION OF THE PREFERRED EMBODIMENTS

All transistors in the preferred embodiments of the present invention are enhancement-type, metal-oxide silicon field effect transistors (i.e., MOSFETs). DC power is supplied by power supply $V_{DDA}$ and reference potential $V_{SSA}$ (e.g. ground). The output paths $I_{OUT}$ (described herein) of the preferred embodiments connect between the reference potential $V_{SSA}$ and other analog circuitry (not shown).

Figure 3:
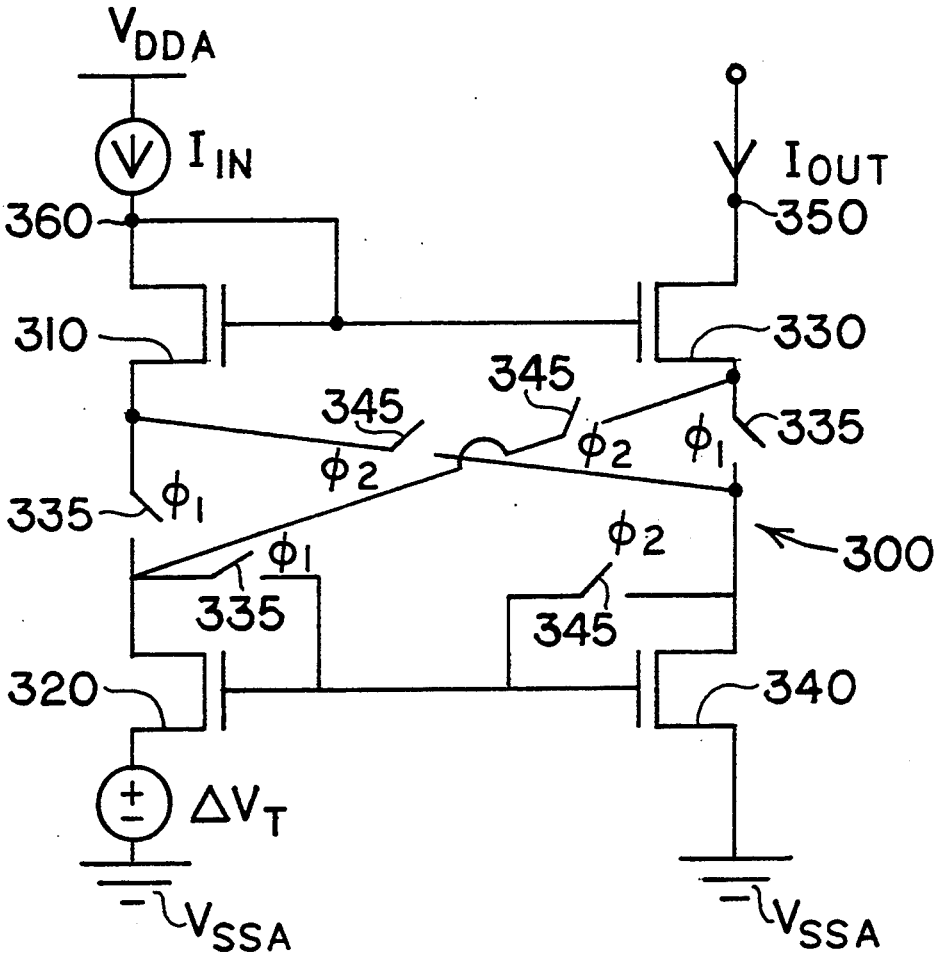
FIG. 3 is a schematic diagram of a first embodiment for a low noise apparatus for receiving an input current and producing an output current which mirrors the input current.
Figure 4:
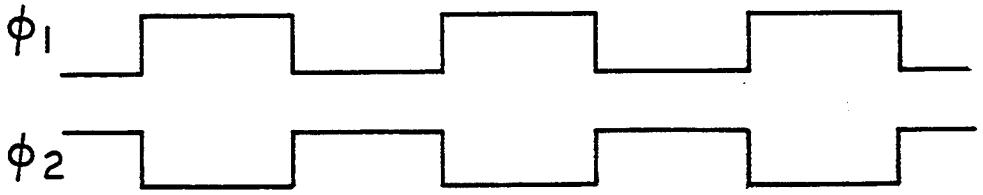
FIG. 4 is a timing diagram of the two clocks utilized with the low noise apparatus of FIGS. 3, 5, 6, 7, 8, 9, and 10.

FIG. 3 illustrates a first embodiment of the present invention. Apparatus 300 comprises: 1) an input node 360 for receiving an input current $I_{IN}$; 2) an output node 350 for delivering an output current $I_{OUT}$ which mirrors $I_{IN}$; 3) N-channel cascode transistors 310 and 330; 4) N-channel sinking transistors 320 and 340; and 5) a switching network comprising switches 335 and 345 formed within electrical paths $\phi 1$ and $\phi 2$, respectively (herein referred to as paths). Any suitable device capable of generating an oscillating signal, such as an oscillator, may activate/deactivate switches 335 and 345. For example, switches 335 may be activated and switches 345 deactivated during a first state of the signal, while switches 335 may be deactivated and switches 345 activated during a second state of the signal. However, in this preferred embodiment, clock $\phi 1$ (not shown) controls switches 335 and clock $\phi 2$ (not shown) controls switches 345. FIG. 4 illustrates a timing diagram of clocks $\phi 1$ and $\phi 2$, which are inverses of each other.

Again referring to FIG. 3, any suitable switch may implement switches 335 and 345, such as CMOS transmission gates or field effect transistors. However, in this preferred embodiment, switches 335 and 345 are implemented using N-channel MOSFETs (not shown). The gates (not shown) of the MOSFETs which implement switches 335 and 345 connect to clocks $\phi 1$ and $\phi 2$, respectively.

For every positive cycle of clock $\phi 1$ and negative cycle of clock $\phi 2$ (e.g., clock $\phi 1$ is in its first state and clock $\phi 2$ is in its second state), switches 335 close, while switches 345 remain open. By closing switches 335 and opening switches 345, transistor 310 connects to transistor 320, the gate of transistor 320 connects to its drain, and transistor 330 connects to transistor 340, thereby forming a first cascode current mirror. The first cascode current mirror receives the input current $I_{IN}$ at input node 360. The input current $I_{IN}$ flows through a reference current path (i.e., transistors 310 and 320), while $I_{OUT(\phi 1)}$ flows through an output path (i.e., transistors 330 and 340). In this manner, the output current $I_{OUT(\phi 1)}$ at output node 350 mirrors the input current $I_{IN}$ at input node 360.

Conversely, for every positive cycle of clock $\phi 2$ and negative cycle of clock $\phi 1$, (e.g., clock $\phi 2$ is in its first state and clock $\phi 1$ is in its second state), switches 345 close, while switches 335 remain open. By closing switches 345 and opening switches 335, transistor 310 connects to transistor 340, the gate of transistor 340 connects to its drain, and transistor 330 connects to transistor 320, thereby forming a second cascode current mirror. The second cascode current mirror receives the input current $I_{IN}$ at input node 360. The input current $I_{IN}$ flows through a reference current path (i.e., transistors 310 and 340), while $I_{OUT(\phi 2)}$ flows through an output path (i.e., transistors 330 and 320). In this manner, the output current $I_{OUT(\phi 2)}$ at output node 350 mirrors the input current $I_{IN}$ at input node 360.

However, for the output current $I_{OUT}$ of apparatus 300 to exactly mirror the input current $I_{IN}$, transistors 310 and 330 must have identical threshold voltage drops (i.e., $V_T$). Similarly, transistors 320 and 340 must have identical threshold voltage drops (i.e., $V_T$). TO accomplish this, transistors 310 and 330 must be equal in size and transistors 320 and 340 must be equal in size. Consequently, transistors 310 and 330 and transistors 320 and 340 are fabricated to be as close in size as possible. Unfortunately, as previously described, two exactly sized transistors cannot be fabricated due to inherent errors associated with currently available fabrication techniques. Consequently, the $V_T$ Of transistors 320 and 340 and transistors 310 and 330 are not identical. A first-order model of this threshold voltage mismatch $\Delta V_T$ between transistors 320 and 340 is illustrated in FIG. 3.

The repeated cycles of opening and closing switches 335 and 345 to connect and disconnect transistors 320 and 340 to/from transistors 310 and 330 can be thought of as alternately chopping transistors 320 and 340. By alternately chopping transistors 320 and 340, the transistor with the threshold voltage mismatch $\Delta V_T$ (e.g., transistor 320) is alternately switched from the reference current path to the output current path at a sufficiently high rate such that the average output current at output node 350 accurately represents the input current at input node 360 (described by equations herein).

Figure 1:
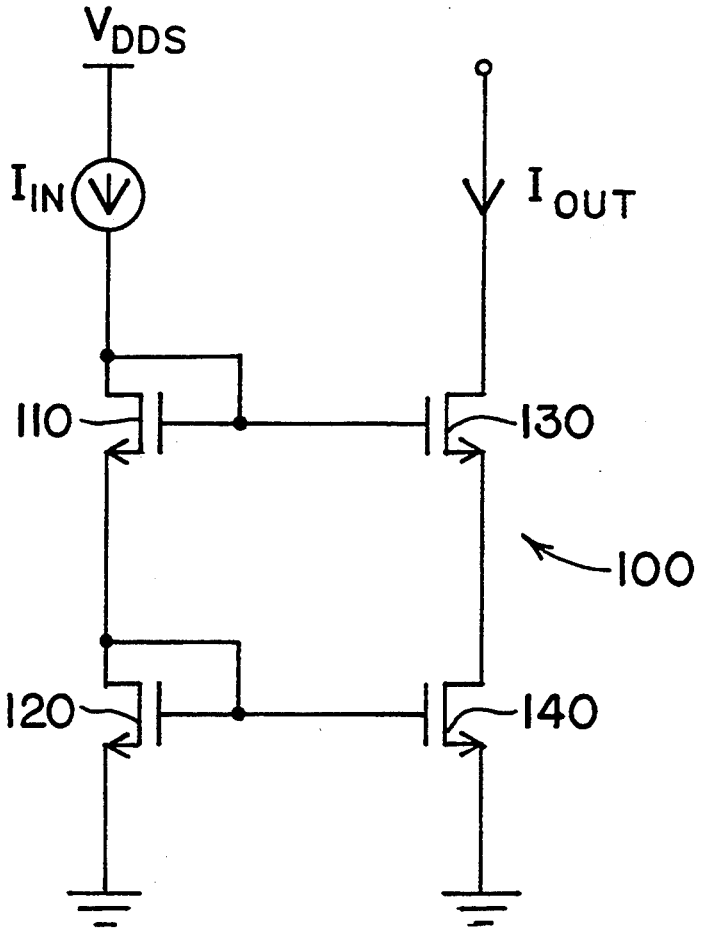
FIG. 1 PRIOR ART
FIG. 1 is a schematic diagram of a conventional, prior art current mirror.
Figure 2:
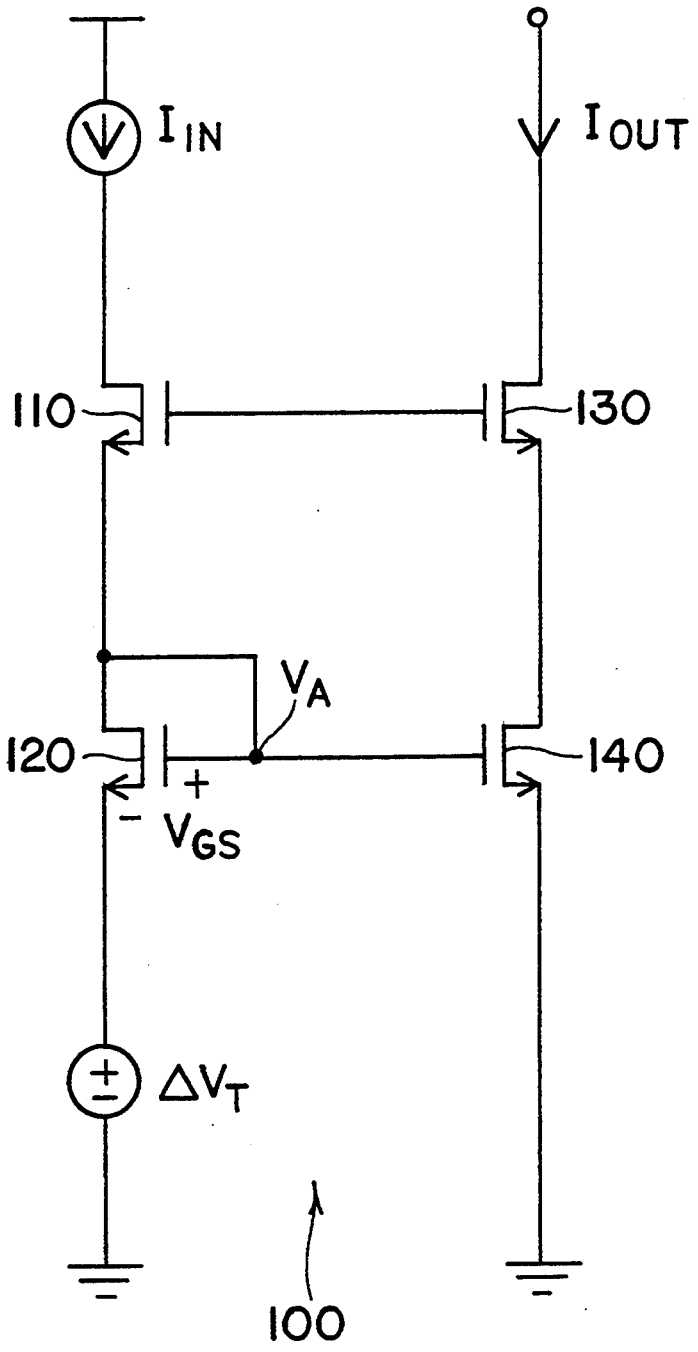
FIG. 2 PRIOR ART
FIG. 2 is a schematic diagram of the conventional, prior art current mirror of FIG. 1 further illustrating a threshold voltage mismatch.
Figure 5:
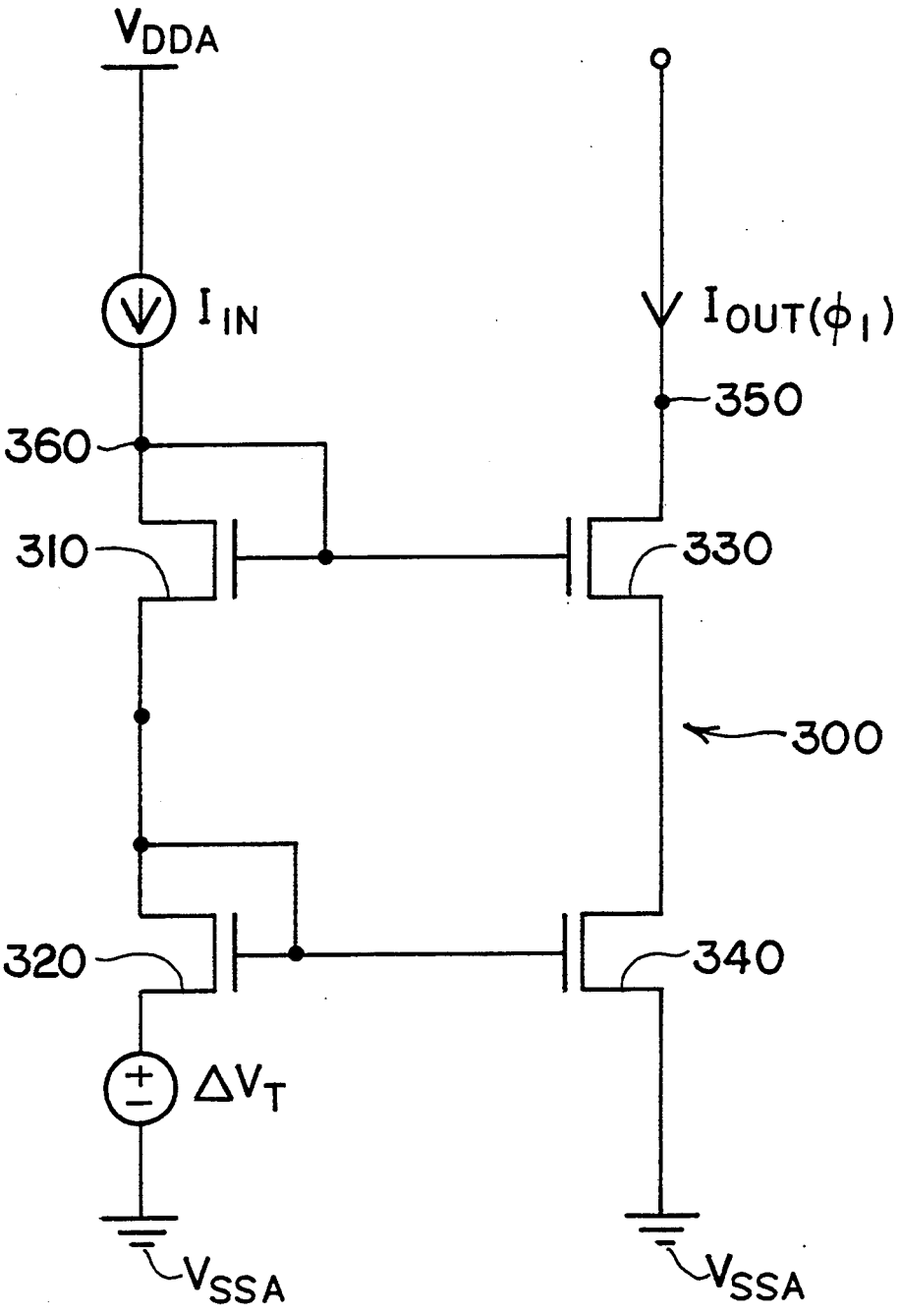
FIG. 5 is a schematic diagram of the low noise apparatus of FIG. 3 during a positive cycle of one clock.
Figure 6:
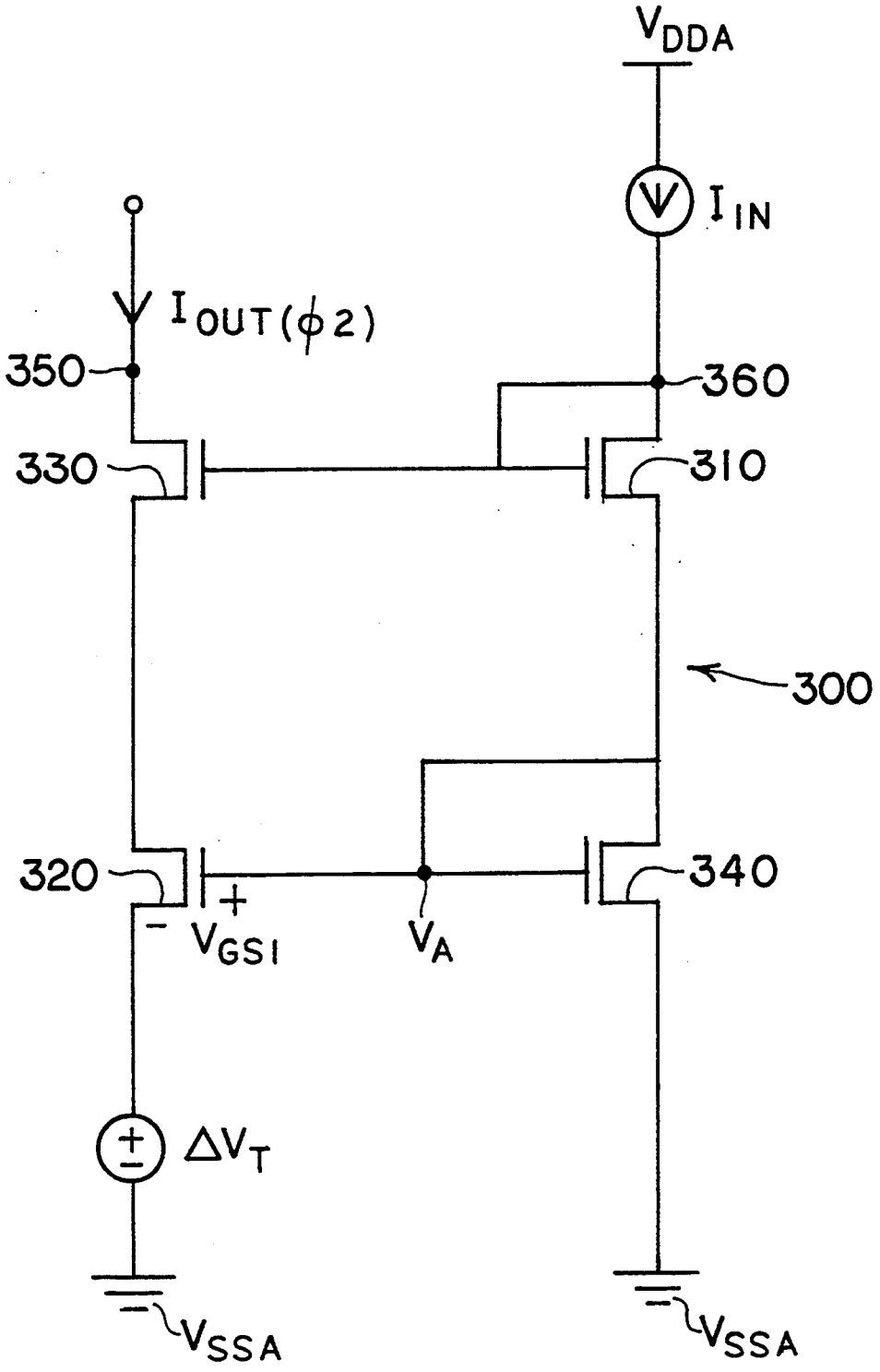
FIG. 6 is a schematic diagram of the low noise apparatus of FIG. 3 during the positive cycle of the other clock.

FIG. 5 illustrates the first cascode current mirror of apparatus 300 which is formed during positive cycles of clock $\phi 1$. FIG. 5 also illustrates the first order model of the threshold voltage mismatch $\Delta V_T$ between transistors 320 and 340. As shown in FIGS. 1 and 5, the structure of apparatus 300 during positive cycles of clock $\phi 1$ is identical to the structure of prior art current mirror 100. Consequently, $I_{OUT(\phi 1)}$ for apparatus 300 is identical to $I_{OUT}$ for prior art current mirror 100:

$$I_{OUT(\phi 1)}=I_{IN}+2(k')(w/l)(\Delta V_T)[I_{IN}/(k'(w/l))]^{1/2}+k'(w/l)(\Delta V_T)^2 \quad (7)$$

where k' is the process parameter, w/l is the size of transistor 340, and $\Delta V_T$ is the threshold voltage mismatch between transistors 320 and 340. FIG. 6 illustrates the second cascode current mirror of apparatus 300 during positive cycles of clock $\phi 2$. FIG. 6 also illustrates the first order model of the threshold voltage mismatch $\Delta V_T$ between transistors 320 and 340. During positive cycles of $\phi 2$, the input current $I_{IN}$ and output current $I_{OUT(\phi 2)}$ for apparatus 300 can be approximated by solving the following equations:

$$I_{IN}=k'(w/l)[V_A-V_T]^2$$

where k' is the process parameter, w/l is the size of transistor 340, $V_T$ is the threshold voltage of transistor 340, and $V_A$ is the voltage at the gate of transistors 320 and 340. Solving for $V_A$:

$$V_A=[I_{IN}/(k'(w/l))]^{1/2}+V_T \quad (8)$$

During positive cycles of $\phi 2$, the output current $I_{OUT(\phi 2)}$ for apparatus 300 can be approximated by solving the following equations:

$$V_{GS1}=V_A-\Delta V_T$$

$$I_{OUT(\phi 2)}=k'(w/l)[V_{GS1}-V_T]^2$$

where k' is the process parameter, w/l is the size of transistor 320, $V_{GS1}$ is the gate-to-source voltage across transistor 320, $V_T$ is the threshold voltage of transistor 320, and $V_A$ is the voltage at the gate of transistors 320 and 340. Therefore:

$$I_{OUT(\phi 2)}=K'(w/l)[V_A-\Delta V_T-V_T]^2 \quad (9)$$

Substituting equation 8 into 9:

$$I_{OUT(\phi 2)} = k'(w/l)[(I_{IN}/(k'(w/l))]^{\frac{1}{2}} - \Delta V_T - V_T + V_T]^2 \quad (10)$$
$$I_{OUT(\phi 2)} = k'(w/l)[(I_{IN}/(k'(w/l)) - 2\Delta V_T[I_{IN}/(k'(w/l))]^{\frac{1}{2}} + \Delta V_T^2]$$
$$I_{OUT(\phi 2)} = I_{IN} - 2(k')(w/l)(\Delta V_T)[I_{IN}/(k'(w/l))]^{\frac{1}{2}} + k'(w/l)(\Delta V_T)^2$$

Accordingly, the average DC current lava for apparatus 300 is:

$$I_{AVG}=[I_{OUT(\phi 1)}+I_{OUT(\phi 2)}]/2 \quad (11)$$

However, comparing $I_{OUT(\phi 1)}$ with $I_{OUT(\phi 2)}$:

$$I_{OUT(\phi 1)}=I_{IN}+2(k')(w/l)(\Delta V_T)[I_{IN}/(k'(w/l))]^{1/2}+k'(w/l)(\Delta V_T)^2;$$

$$I_{OUT(\phi 2)}=I_{IN}-2(k')(w/l)(\Delta V_T)[I_{IN}/(k'(w/l))]^{1/2}+k'(w/l)(\Delta V_T)^2;$$

Thus, when $I_{OUT(\phi 1)}$ and $I_{OUT(\phi 2)}$ add together in equation 11, the first order error term $2(k')(w/l)(\Delta V_T)[I_{IN}/(k')(w/l)]^{1/2}$ is eliminated. Accordingly:

$$I_{AVG}=[2I_{IN}+2(k')(w/l)(\Delta V_T)^2]/2$$

$$I_{AVG}=I_{IN}+k'(w/l)\Delta V_T^2$$

Using the identical parameters as those given in the Background of the Invention, namely $$I_{IN} = 50\ \mu A,\ k' = 43 \times 10^{-6}\ A/V^2,$$
$$w/l = 100/10, \text{ and } \Delta V_T = 10\ mV, \text{ then:}$$
$$I_{OUT} = 50 \times 10^{-6} + .034 \times 10^{-6};$$
$$I_{OUT} = 50.034\ \mu A$$

Thus, for an input current of 50 $\mu$A, the output current of apparatus 300 is 50.034 $\mu$A, which is an error rate of 0.068% This error rate is a significant improvement over conventional current mirrors. This significant improvement occurs because the first order error term cancels when transistors 320 and 340 are chopped. In effect, apparatus 300 modulates a substantial percentage of the threshold voltage mismatch $\Delta V_T$ and low frequency noise (i.e., $1/f$) up to the operating frequency of clocks $\phi$1 and $\phi$2. The resulting high frequency noise may then be filtered out using any suitable low pass filter.

Figure 7:
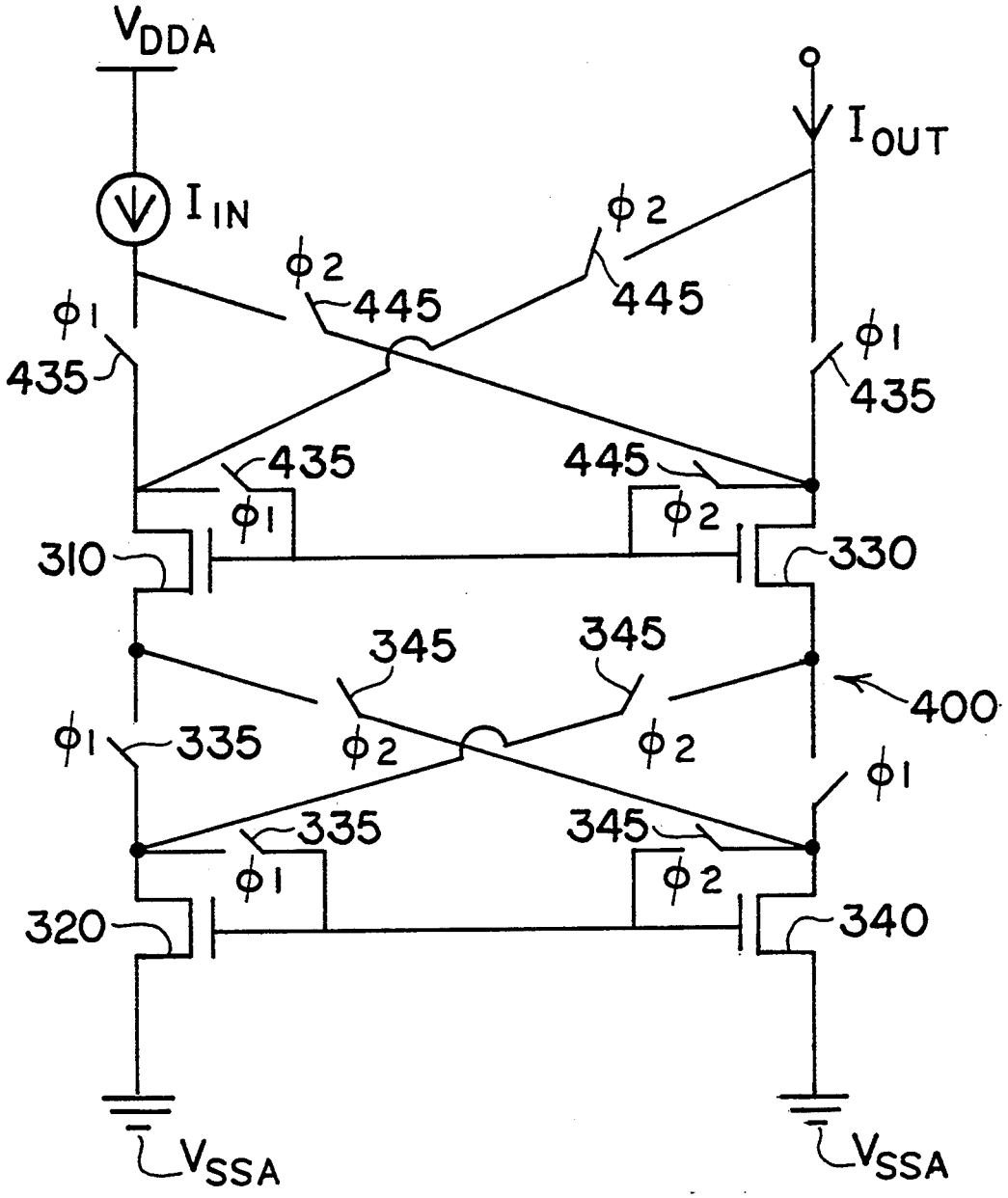
FIG. 7 is a schematic diagram illustrating the low noise apparatus of FIG. 3 having two chopped pairs of transistors.

The present invention overcomes the limitations in the related art and is particularly effective when configured and employed as described herein. However, those skilled in the art will readily recognize that numerous variations and substitutions may be made to the invention to achieve substantially the same results as achieved by the preferred embodiment. For example, although cascode transistors 310 and 330 contribute only to the second order error, they may be chopped as well. FIG. 7 illustrates apparatus 400 having two sets of chopped transistors, namely transistors 310 and 330 and transistors 320 and 340. Switches 335 and 435 are controlled by clock $\phi$1 and switches 345 and 445 are controlled by clock $\phi$2. The operation of chopping transistors 310 and 330 is identical to the operation of chopping transistors 320 and 340.

Figure 8:
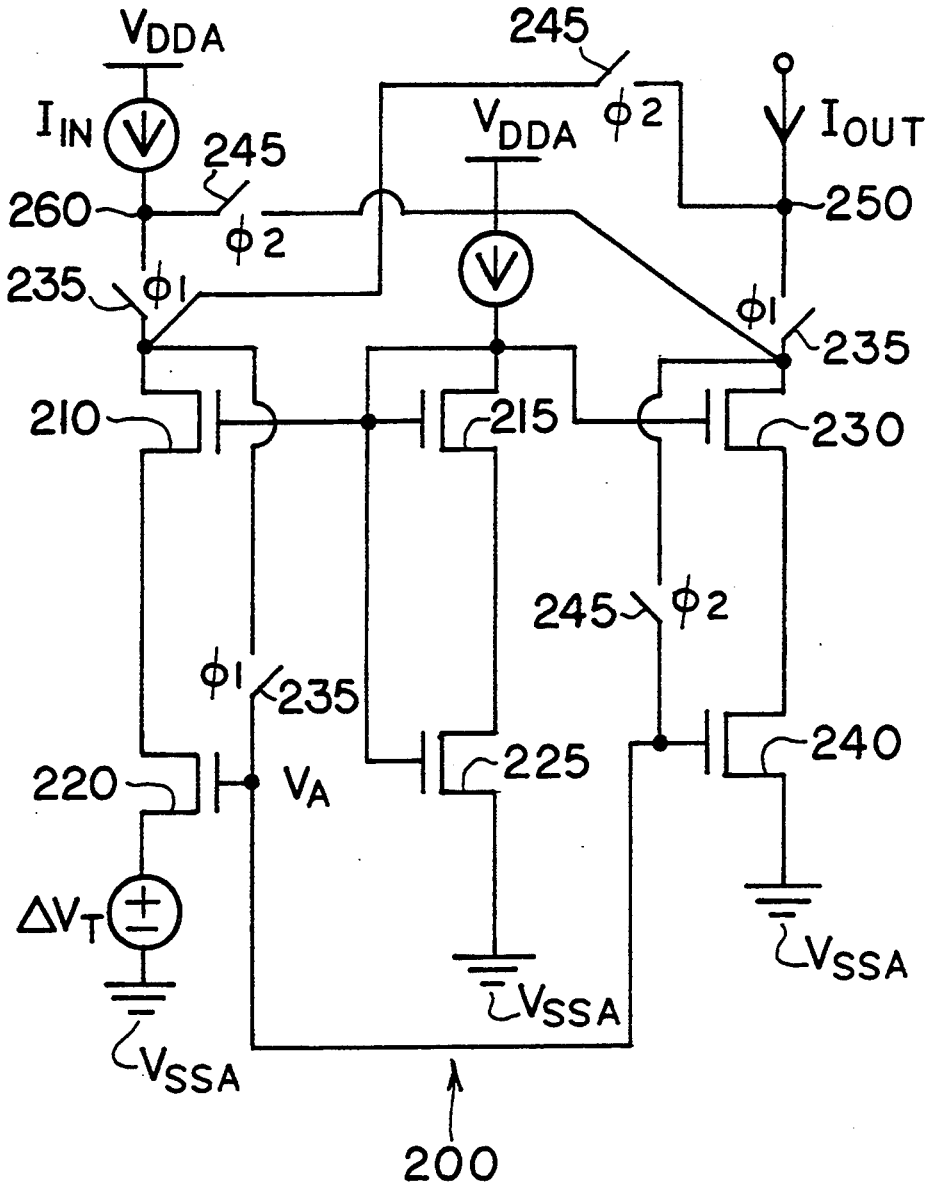
FIG. 8 is a schematic diagram of a second embodiment for a low noise apparatus for receiving an input current and producing an output current which mirrors the input current.

FIG. 8 illustrates a second embodiment of the present invention. Apparatus 200 comprises: 1) input node 260 for receiving an input current; 2) output node 250 for producing an output current which mirrors the input current; 3) N-channel cascode transistors 210 and 230 and N-channel sinking transistors 220 and 240; 4) N-channel bias transistors 215 and 225; and 5) a switching network comprising switches 235 and 245 formed within electrical paths $\phi$1 and $\phi$2, respectively (herein referred to as paths). Bias transistor 215 operates in its saturation region, while bias transistor 225 operates in its triode region. Together, bias transistors 215 and 225 bias the gates of cascode transistors 210 and 230 such that the voltage on output node 250 is capable of swinging nearly rail-to-rail. Further, transistor 225 is sized such that the drain-to-source voltage drops (i.e., $V_{DS}$) across transistors 220 and 240 are slightly larger than the voltage drop required for transistors 220 and 240 to operate in their saturation region. Transistors 220 and 240 have identical $V_{GS}$ because their sources are connected to a reference voltage (e.g., ground) and their gates are connected to each other. Similarly, transistors 210 and 230 have nearly identical $V_{GS}$ because their gates are connected to each other and they have nearly identical drain currents (described herein).

Any suitable device capable of generating an oscillating signal, such as an oscillator, may activate/deactivate switches 235 and 245. For example, switches 235 may be activated and switches 245 deactivated during a first state of the signal, while switches 235 may be deactivated and switches 245 activated during a second state of the signal. However, in this preferred embodiment, clock $\phi$1 (not shown) controls switches 235 and clock $\phi$2 (not shown) controls switches 245. FIG. 4 illustrates a timing diagram of clocks $\phi$1 and $\phi$2, which are inverses of each other.

Again referring to FIG. 8, any suitable switch may implement switches 235 and 245, such as CMOS transmission gates or field effect transistors. However, in this preferred embodiment, switches 235 and 245 are implemented using N-channel MOSFETs (not shown). The gates (not shown) of the MOSFETs which implement switches 235 and 245 connect to clocks $\phi$1 and $\phi$2, respectively.

For every positive cycle of clock $\phi$1 and negative cycle of clock $\phi$2 (e.g., clock $\phi$1 is in its first state and clock $\phi$2 is in its second state), switches 235 close, while switches 245 remain open. By closing switches 235 and opening switches 245, the drain of transistor 210 connects to both input node 260 and the gates of transistors 220 and 240, while the drain of transistor 230 connects to output node 250, thereby forming a first cascode current mirror. The first cascode current mirror receives the input current $I_{IN}$ at input node 260. The input current $I_{IN}$ flows through a reference current path (i.e., transistors 210 and 220), while $I_{OUT(\phi 1)}$ flows through an output path (i.e., transistors 230 and 240). In this manner, the output current $I_{OUT(\phi 1)}$ at output node 250 mirrors the input current $I_{IN}$ at input node 260.

Conversely, for every positive cycle of clock $\phi$2 and negative cycle of clock $\phi$1, (e.g., clock $\phi$2 is in its first state and clock $\phi$1 is in its second state), switches 245 close, while switches 235 remain open. By closing switches 245 and opening switches 235, the drain of transistor 210 connects to output node 250, while the drain of transistor 230 connects to both input node 260 and the gates of transistors 220 and 240, thereby forming a second cascode current mirror. The second cascode current mirror receives the input current $I_{IN}$ at input node 260. The input current $I_{IN}$ flows through a reference current path (i.e., transistors 230 and 240), while $I_{OUT(\phi 2)}$ flows through an output path (i.e., transistors 210 and 220). In this manner, the output current $I_{OUT(\phi 2)}$ at output node 250 mirrors the input current $I_{IN}$ at input node 260.

However, for the output current (i.e., $I_{OUT}$) of apparatus 200 to exactly mirror the input current $I_{IN}$, transistors 210,215, and 230 must have identical threshold voltage drops (i.e., $V_T$). Similarly, transistors 220 and 240 must have identical threshold voltage drops (i.e., $V_T$). To accomplish this, transistors 210, 215, and 230 must be equal in size and transistors 220 and 240 must be equal in size. Consequently, transistors 210, 215, and 230 and transistors 220 and 240 are fabricated to be as close in size as possible. Unfortunately, as previously described, two exactly sized transistors cannot be fabricated due to inherent errors associated with currently available fabrication techniques. As a result, the threshold voltage $V_T$ of transistors 220 and 240 and transistors 210, 215, and 230 are not identical. FIG. 8 illustrates the first order model of this threshold voltage mismatch $\Delta V_T$ between transistors 220 and 240.

The repeated cycles of opening and closing switches 235 and 245 to connect and disconnect transistors 210 and 230 to/from input node 260 and output node 250 can be thought of as alternately chopping transistors 210 and 220 with transistors 230 and 240. By alternately chopping these transistors, the transistor with the threshold voltage mismatch $\Delta V_T$ (e.g., transistor 220) is alternately switched from the reference current path to the output current path at a sufficiently high rate such that the average output current at output node 250 accurately represents the input current at input node 260 (described by equations herein).

Figure 9:
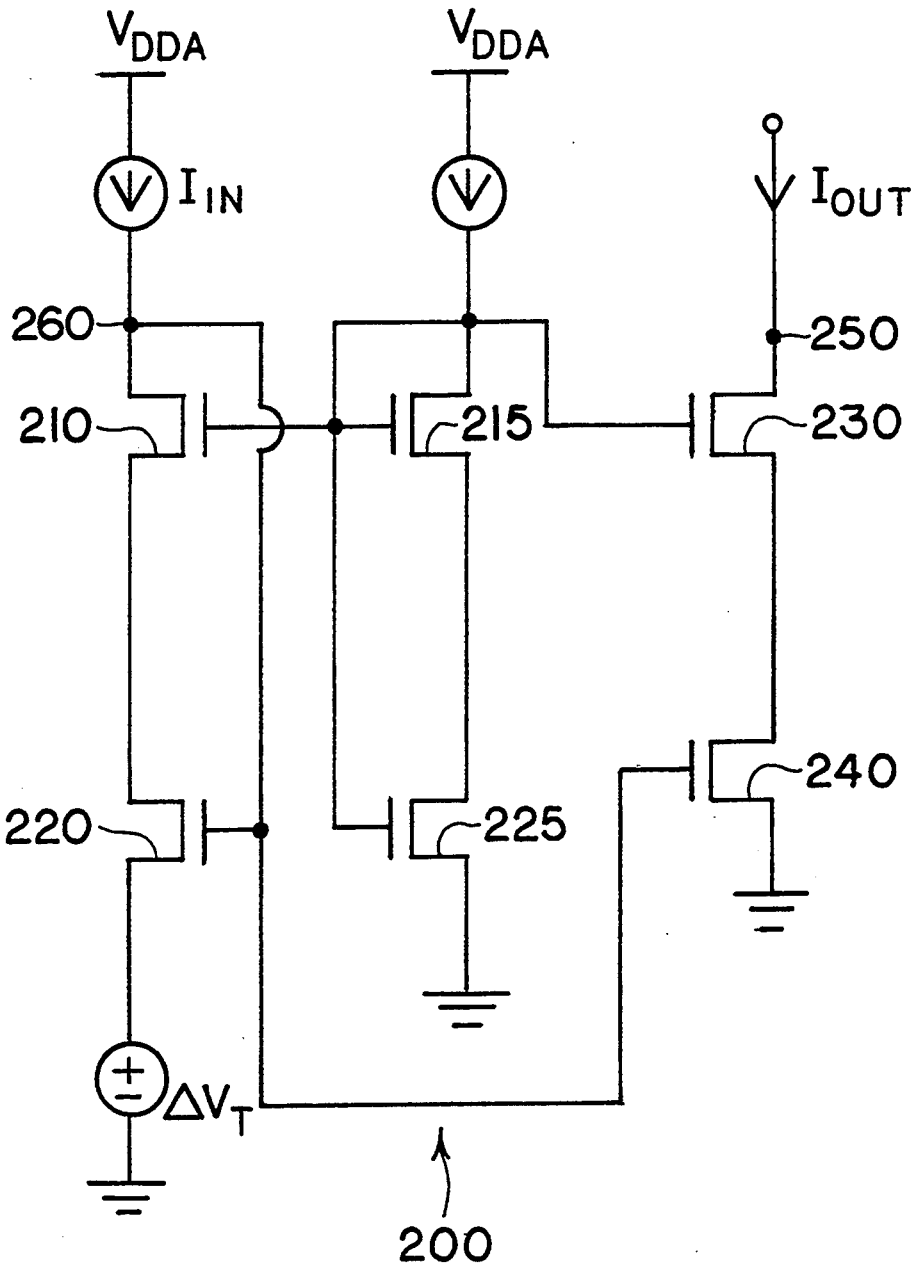
FIG. 9 is a schematic diagram of the low noise apparatus of FIG. 8 during a positive cycle of one clock.

FIG. 9 illustrates the first cascode current mirror of apparatus 200 which is formed during positive cycles of clock $\phi 1$. FIG. 9 also illustrates the first order model of the threshold voltage mismatch $\Delta V_T$ between transistors 220 and 240. During positive cycles of clock $\phi 1$, the $I_{OUT(\phi 1)}$ of the second embodiment is identical to the $I_{OUT(\phi 1)}$ of the first embodiment. Therefore:

$$I_{OUT(\phi 1)}=I_{IN}+2(k')(w/l)(\Delta V_T)[I_{IN}/(k'(w/l))]^{1/2}+k'(w/l)(\Delta V_T)^2 \quad (7)$$

where k' is the process parameter, w/l is the size of transistor 240, and $\Delta V_T$ is the threshold voltage mismatch between transistors 220 and 240.

Figure 10:
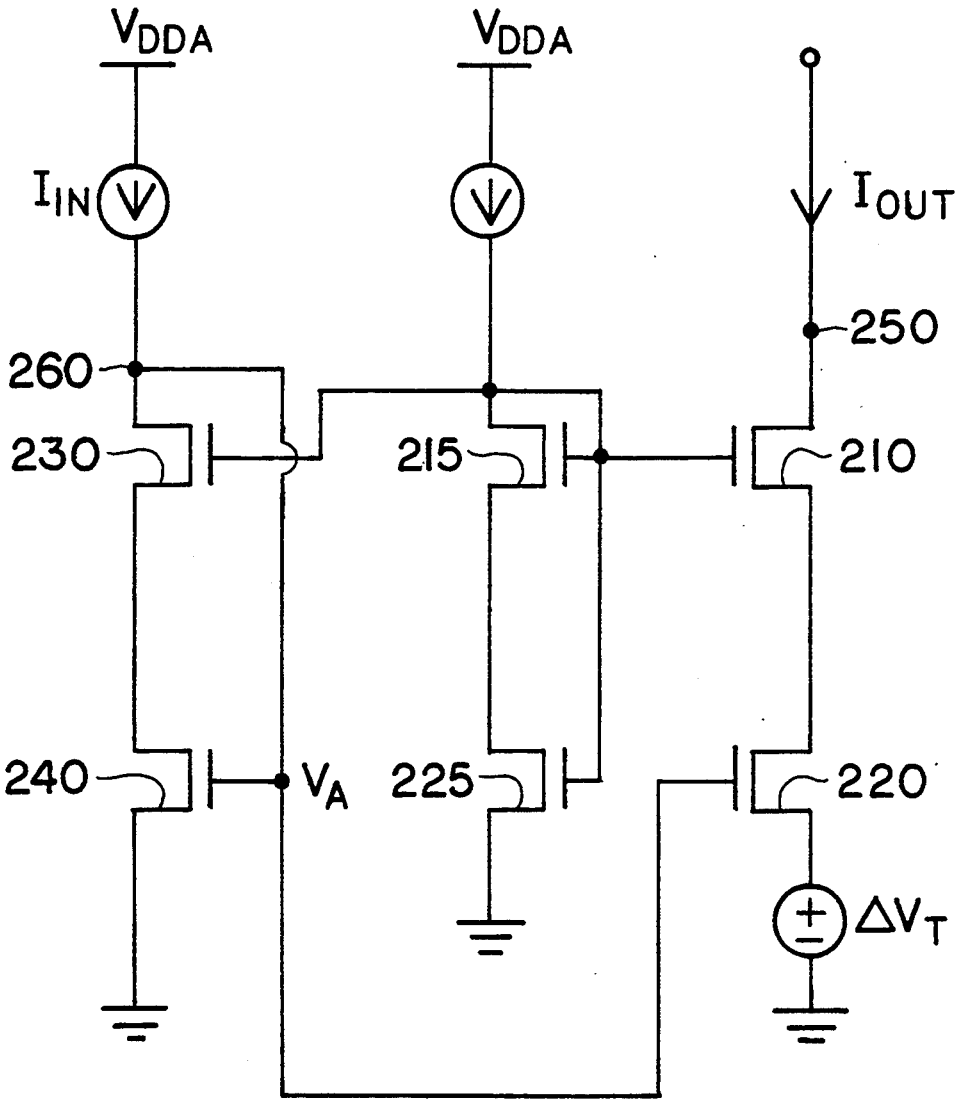
FIG. 10 is a schematic diagram of the low noise apparatus of FIG. 8 during the positive cycle of the other clock.

FIG. 10 illustrates the second cascode current mirror of apparatus 200 during positive cycles of clock $\phi 2$. FIG. 10 also illustrates the first order model of the threshold voltage mismatch $\Delta V_T$ between transistors 220 and 240. During positive cycles of $\phi 2$, the input current $I_{IN}$ and output current $I_{OUT(\phi 2)}$ for apparatus 200 can be approximated by solving the following equations:

$$I_{IN}=(k')(w/l)[V_A-V_T]^2$$

where k' is the process parameter, w/l is the size of transistor 240, $V_T$ is the threshold voltage of transistor 240, and $V_A$ is the voltage at the gate of transistors 220 and 240. Solving for $V_A$:

$$V_A=[I_{IN}/(k'(w/l))]^{1/2}+V_T \quad (8)$$

During positive cycles of $\phi 2$, the output current $I_{OUT(\phi 2)}$ for apparatus 200 can be approximated by solving the following equations:

$$V_{GS1}=V_A-\Delta V_T$$

$$I_{OUT(\phi 2)}=k'(w/l)[V_{GS1}-V_T]^2$$

where k' is the process parameter, w/l is the size of transistor 220, $V_A$ is the gate-to-source voltage across transistor 220, $V_T$ is the threshold voltage of transistor 220, and $V_A$ is the voltage at the gate of transistors 220 and 240. Therefore:

$$I_{OUT(\phi 2)}=k'(w/l)[V_A-\Delta V_T-V_T]^2 \quad (9)$$

Substituting equation 8 into 9:

$$I_{OUT(\phi 2)} = k'(w/l)[(I_{IN}/k'(w/l))^{\frac{1}{2}} - \Delta V_T - V_T + V_T]^2 \quad (10)$$
$$I_{OUT(\phi 2)} = k'(w/l)[I_{IN}/(k'(w/l)) - 2\Delta V_T(I_{IN}/k'(w/L))^{\frac{1}{2}} + \Delta V_T^2]$$
$$I_{OUT(\phi 2)} = I_{IN} - 2(k')(w/l)(\Delta V_T)(I_{IN}/k'(w/l))^{\frac{1}{2}} + k'(w/l)(\Delta V_T)^2$$

Accordingly, the average DC current $I_{AVG}$ for apparatus 300 is:

$$I_{AVG}=[I_{OUT(\phi 1)}+I_{(OUT(\phi 2)}]/2 \quad (11)$$

However, comparing $I_{OUT(\phi 1)}$ with $I_{OUT(\phi 2)}$:

$$I_{OUT(\phi 1)}=I_{IN}+2(k')(w/l)(\Delta V_T)[I_{IN}/(k'(w/l))]^{1/2}+k'(w/l)(\Delta V_T)^2;$$

$$I_{OUT(\phi 2)}=I_{IN}-2(k')(w/l)(\Delta V_T)[I_{IN}/(k'(w/l))]^{1/2}+k'(w/l)(\Delta V_T)^2;$$

Thus, when $I_{OUT(\phi 1)}$ and $I_{OUT(\phi 2)}$ add together in equation 11, the first order error term $2(k')(w/l)(\Delta V_T)[I_{IN}/(k')(w/l)]^{1/2}$ is eliminated. Accordingly:

$$I_{AVG}=[2I_{IN}+2(k')(w/l)(\Delta V_T)^2]/2$$

$$I_{AVG}=I_{IN}+k'(w/l)\Delta V_T^2$$

Using the identical parameters as those given in the Background of the Invention, namely $I_{IN}=50\ \mu A$, $k'=43\times 10^{-6}\ A/V^2$, $w/l=100/10$, and $\Delta V_T=10$ mV, then:

$$I_{OUT}=50\times 10^{-6}+0.034\times 10^{-6};$$

$$I_{OUT}=50.034\ \mu A$$

Thus, for an input current of 50 $\mu$A, the output current of apparatus 200 is 50.034 $\mu$A, which is an error rate of 0.068%. This error rate is a significant improvement over conventional current mirrors. This significant improvement occurs because the first order error term cancels when transistors 210 and 220 and transistors 230 and 240 are chopped. In effect, apparatus 200 modulates a substantial percentage of the threshold voltage mismatch $\Delta V_T$ and low frequency noise (i.e., $1/f$) up to the operating frequency of clocks $\phi 1$ and $\phi 2$. The resulting high frequency noise may then be filtered out using any suitable low pass filter.

The present invention overcomes the limitations in the related art and is particularly effective when configured and employed as described herein. However, those skilled in the art will readily recognize that numerous variations and substitutions may be made to the invention to achieve substantially the same results as achieved by the preferred embodiments. Although the present invention has been described in terms of the foregoing preferred embodiments, this description has been provided by way of explanation only and is not necessarily to be construed as a limitation of the invention. Illustratively, while the preferred embodiments are implemented in a P-well process, numerous CMOS processes, including twin tub and N-well, are suitable as well. Furthermore, while CMOS technology is used to advantage in the embodiments shown, any semiconductor circuitry which exhibits similar or even more advantageous characteristics could be substituted. For example, improved logic structures and innovative integrated circuit technology such as silicon-on-insulator structures could be substituted to improve circuit operation speed and reduce power consumption. Accordingly, various other embodiments and modifications and improvements not described herein may be within the spirit and scope of the invention, as defined by the following claims.

I claim:

1. An apparatus for receiving an input current and producing an output current which mirrors the input current, comprising:

a first cascode current mirror having an input for receiving the input current and having an output;

a second cascode current mirror having an input for receiving the input current and having an output, said output connected to said output of said first current mirror; and means for alternately activating said first and second cascode current mirrors to produce a current on their common output which mirrors the input current;

wherein said alternately activating means comprises:

means for generating a signal having a first state and a second state; and a switching network for activating said first cascode current mirror during the first state of said signal and for activating said second cascode mirror during the second state of said signal.

2. The apparatus according to claim 1 wherein said generating means comprises a clock.

3. The apparatus according to claim 2 wherein said alternately activating means further comprises:

a second clock having a first and second state; and said switching network for deactivating said first cascode current mirror during the first state of said second clock and for deactivating said second cascode current mirror during the second state of said second clock.

4. The apparatus according to claim 1 wherein said switching network comprises:

a first plurality of transistors, each having a control terminal for activating and deactivating said transistor when said signal is in the first and second state, respectively, thereby activating and deactivating said first cascode current mirror when said signal is in the first and second state, respectively; and a second plurality of transistors, each having a control terminal for activating and deactivating said transistor when said signal is in the second and first state, respectively, thereby activating and deactivating said second cascode current mirror when said signal is in the second and first state, respectively.

5. The apparatus according to claim 1 wherein said first and second cascode current mirrors each comprise:

a first and second transistor, each having a first terminal, a control terminal connected to each other, and a second terminal; and a third and fourth transistor, each having a first terminal connected to a reference voltage, a control terminal connected to each other, and a second terminal.

6. The apparatus according to claim 5 wherein said alternately activating means further comprises:

said switching network for connecting said second terminal of said first and second transistors to said second terminal of said third and fourth transistors, respectively, when said signal is in the first state;

said switching network for connecting said second terminal of said first and second transistors to said second terminal of said fourth and third transistors, respectively, when said signal is in the second state; and said switching network for connecting said second terminal of said third transistor to said control terminal of said third transistor when said signal is in the first state, and for connecting said second terminal of said fourth transistor to said control terminal of said fourth transistor when said signal is in the second state.

7. The apparatus according to claim 1 wherein said first and second cascode current mirrors each comprise:

a first and second transistor, each having a first terminal, a control terminal connected to each other, and a second terminal;

a third and fourth transistor, each having a first terminal connected to a reference voltage, a control terminal connected to each other, and a second terminal;

a fifth and sixth transistor, said fifth transistor having a control terminal connected to said control terminals of said first and second transistors, a first terminal, and a second terminal; and said sixth transistor having a control terminal connected to said control terminal of said fifth transistor, a first terminal connected to said reference voltage, and a second terminal connected to said second terminal of said fifth transistor.

8. The apparatus according to claim 7 wherein said alternately activating means further comprises:

said switching network for connecting said first terminal of said first transistor to said input of said first cascode current mirror and said control terminals of said third and fourth transistors, and for connecting said first terminal of said second transistor to said output of said first cascode current mirror when said signal is in the first state; and said switching network for connecting said first terminal of said second transistor to said input of said second cascode current mirror and said control terminals of said third and fourth transistors, and for connecting said first terminal of said first transistor to said output of said second cascode current mirror when said signal is in the second state.

* * * * *